US007176753B2

(12) United States Patent
Noda et al.

(10) Patent No.: US 7,176,753 B2
(45) Date of Patent: Feb. 13, 2007

(54) METHOD AND APPARATUS FOR OUTPUTTING CONSTANT VOLTAGE

(75) Inventors: Ippei Noda, Osaka-fu (JP); Kohzoh Itoh, Hyogo-ken (JP)

(73) Assignee: Ricoh Company, Ltd., Tokyo (JP)

( * ) Notice: Subject to any disclaimer, the term of this patent is extended or adjusted under 35 U.S.C. 154(b) by 59 days.

(21) Appl. No.: 11/039,286

(22) Filed: Jan. 19, 2005

(65) Prior Publication Data

US 2005/0162218 A1 Jul. 28, 2005

(30) Foreign Application Priority Data

Jan. 23, 2004 (JP) ..... 2004-015724

(51) Int. Cl.
*G06G 7/12* (2006.01)
*G05F 1/10* (2006.01)

(52) U.S. Cl. ..... 327/543; 327/563

(58) Field of Classification Search ..... 327/52–54, 327/530, 535, 537–538, 540–543, 563
See application file for complete search history.

(56) References Cited

U.S. PATENT DOCUMENTS

| | | | | | |
|---|---|---|---|---|---|
| 6,060,945 | A * | 5/2000 | Tsay | ..... | 327/543 |
| 6,127,881 | A * | 10/2000 | Tsay et al. | ..... | 327/538 |
| 6,297,624 | B1 * | 10/2001 | Mitsui et al. | ..... | 323/316 |
| 2002/0180453 | A1 | 12/2002 | Itoh | ..... | 324/525 |
| 2004/0004851 | A1 | 1/2004 | Itoh | ..... | 363/124 |

* cited by examiner

*Primary Examiner*—My-Trang Nu Ton
(74) *Attorney, Agent, or Firm*—Cooper & Dunham LLP

(57) ABSTRACT

A constant voltage outputting apparatus includes a differential amplifier circuit, an amplifier circuit, a current adjustment device and a stabilization circuit. The differential amplifier circuit performs a differential amplifying operation and outputs a differential amplified voltage. The amplifier circuit amplifies the differential amplified voltage output from the differential amplifier circuit. The current adjustment device adjusts a current characteristic of the amplifier circuit. The stabilization circuit stabilizes a state of the current adjustment device. A constant voltage outputting method is also described.

27 Claims, 5 Drawing Sheets

METHOD AND APPARATUS FOR OUTPUTTING CONSTANT VOLTAGE

BACKGROUND

1. Field

This patent specification relates to a method and apparatus for outputting a constant voltage to a load by using a differential amplifier circuit.

2. Discussion of the Background

In recent years, a lithium ion battery has been widely used as a power source for mobile devices. The operating voltage of the lithium ion battery is about 3.7 V, which is approximately three times of an operating voltage of a Ni—Cd battery or a nickel hydride battery. Therefore, the lithium ion battery can reduce the number of batteries used in a mobile device. Further, the lithium ion battery is light in weight. Accordingly, the lithium ion battery contributes to reduction in size and weight of the mobile device. When the lithium ion battery is used in the mobile device, however, an initial voltage of the lithium ion battery immediately after charging is about 4.3 V, but a final voltage of the battery after discharging is reduced to about 3.2 V. Therefore, the voltage of the lithium ion battery may need to be stabilized by a constant voltage circuit.

FIG. 1 illustrates an exemplary configuration of a background constant voltage circuit. The background constant voltage circuit 11 includes a reference voltage source Rp, a bias voltage source Bp, a differential amplifier circuit Damp, an amplifier circuit Vamp, an output voltage control transistor M8, output voltage detection resistors R1 and R2, and a current adjustment transistor M7. The constant voltage circuit 11 receives a voltage VBAT from a power source P and outputs an output voltage Vout to a load Lo.

The differential amplifier circuit Damp performs a differential amplifying operation and outputs a voltage generated through the operation. The amplifier circuit Vamp then amplifies the voltage output from the differential amplifier circuit Damp. The output voltage control transistor M8, which may be a P-channel MOSFET (metal-oxide semiconductor field-effect transistor), for example, serving as an output voltage control device, receives the voltage amplified by the amplifying circuit Vamp and outputs an output voltage Vout to the load Lo. The output voltage detection resistors R1 and R2 detect and divide the output voltage Vout to generate a divided voltage. The divided voltage and a reference voltage Vref output from the reference voltage source Rp are input in the differential amplifying circuit Damp and used for the differential amplifying operation.

The differential amplifier circuit Damp includes two differential input transistors M1 and M2, a current regulation transistor M5 and a current mirror circuit Cm1.

The differential input transistors M1 and M2 may be N-channel MOSFETs, for example, and the current regulation transistor M5 may be an N-channel MOSFET, for example, serving as a current regulation device driven by a bias voltage Vbi1 output from the bias voltage source Bp.

The current mirror circuit Cm1 includes two transistors M3 and M4 connected to the power source P. The transistors M3 and M4 may be P-channel MOSFETs, for example. Each of the transistors M3 and M4 has a source connected to the power source P, and a gate connected to a drain of the transistor M3. Further, drains of the transistors M3 and M4 are connected to drains of the differential input transistors M1 and M2, respectively.

The differential input transistor M1 has a gate connected to a positive terminal of the reference voltage source Rp.

Meanwhile, the other differential input transistor M2 has a gate connected to an output voltage dividing point between the output voltage detection resistors R1 and R2. Sources of the differential input transistors M1 and M2 are connected to a drain of the current regulation transistor M5.

The current regulation transistor M5, the drain of which is connected to both of the sources of the differential input transistors M1 and M2, has a gate connected to the bias voltage source Bp and a source connected to a ground voltage terminal GND. The current regulation transistor M5 regulates a drain current Id1 of the differential input transistor M1 and a drain current Id2 of the differential input transistor M2.

Further, a current adjustment transistor M7, which may be an N-channel MOSFET, for example, serving as a current adjustment device, forms a current mirror circuit Cm2 together with the current regulation transistor M5. The current adjustment transistor M7 is connected between the amplifier circuit Vamp described below and the ground voltage terminal GND. The current adjustment transistor M7 has a gate connected to the bias voltage source Bp, a drain connected to a drain of an amplifier transistor M6, (i.e., a point Va to which an output voltage from the amplifier circuit Vamp is output) and a source connected to the ground voltage terminal GND.

The amplifier transistor M6 included in the amplifier circuit Vamp, which may be a P-channel MOSFET, for example, has a gate connected to the drain of the differential input transistor M2, and a source connected to the power source P.

The output voltage control transistor M8 has a gate connected to the drain of the amplifier transistor M6, a source connected to the power source P, and a drain connected to the predetermined load Lo via an output terminal Vr and to the output voltage detection resistors R1 and R2 connected in series.

As described above, the output voltage detection resistors R1 and R2 have the output voltage dividing point connected to the gate of the differential input transistor M2. The output voltage detection resistor R2 is connected to the ground voltage terminal GND.

Operations of the constant voltage circuit 11 of FIG. 1 are briefly described. When the output voltage Vout from the output terminal Vr is decreased for some reason, a gate voltage of the differential input transistor M2 is decreased, so that the drain current Id2 of the differential input transistor M2 is decreased and a drain voltage Vd2 of the differential input transistor M2 is increased. Since the drain voltage Vd2 of the differential input transistor M2 is also a gate voltage of the amplifier transistor M6, the gate voltage of the amplifier transistor M6 is also increased. Accordingly, a drain voltage Vd6 of the amplifier transistor M6 (i.e., an electric potential at the point Va to which the output voltage from the amplifier circuit Vamp is output) is decreased. Since the drain voltage Vd6 of the amplifier transistor M6 (i.e., the electric potential at the point Va) is output to the gate of the output voltage control transistor M8, a gate voltage of the output voltage control transistor M8 is decreased, so that the output voltage Vout from the output terminal Vr is increased to a predetermined value.

Conversely, when the output voltage Vout is increased for some reason, an inverse operation to the above-described operation is observed. That is, the gate voltage of the differential input transistor M2 is increased, so that the drain current Id2 of the differential input transistor M2 is increased and the drain voltage Vd2 of the differential input transistor M2 is decreased. Since the drain voltage Vd2 of the differential input transistor M2 is also the gate voltage of the amplifier transistor M6, the gate voltage of the amplifier transistor M6 is also decreased. Accordingly, the drain voltage Vd6 of the amplifier transistor M6 (i.e., the electric potential at the point Va to which the output voltage from the amplifier circuit Vamp is output) is increased. Since the drain voltage Vd6 of the amplifier transistor M6 (i.e., the electric potential at the point Va) is output to the gate of the output voltage control transistor M8, the gate voltage of the output voltage control transistor M8 is increased, so that the output voltage Vout from the output terminal Vr is decreased to a predetermined value.

In other words, in the above constant voltage circuit 11 of FIG. 1, even when the output voltage Vout is changed for some reason, the gate voltage of the amplifier transistor M6 is changed in an opposite direction to a direction in which the gate voltage of the differential input transistor M2 is changed in response to a change of the output voltage Vout. Therefore, the electric potential at the point Va is changed in an opposite direction to the direction in which the gate voltage of the amplifier transistor M6 is changed, and the gate voltage of the output voltage control transistor M8 is changed in the same opposite direction in which the electric potential at the point Va is changed, so that a value of the output voltage Vout from the output terminal Vr is kept constant.

However, the above background constant voltage circuit 11 has a problem that, within the differential amplifier circuit Damp, a balance is lost between the drain current Id1 of the differential input transistor M1 and the drain current Id2 of the differential input transistor M2 and thus there arises an input offset voltage, which is a difference in voltage between the gate (i.e., an input terminal) of the differential input transistor M1 and the gate (i.e., an input terminal) of the differential input transistor M2, causing deterioration in accuracy of the output voltage Vout. Mechanism of deterioration in accuracy of the output voltage Vout is explained below.

The input offset voltage is reduced by equalizing the drain current Id1 of the differential input transistor M1 with the drain current Id2 of the differential input transistor M2. The drain current Id1 becomes equal to the drain current Id2 when a drain-source voltage Vds3 and a drain-source voltage Vds4, which are respectively drain-source voltages of the transistor M3 and the transistor M4 forming the current mirror circuit Cm1, are equal. The drain-source voltage Vds3 of the transistor M3 is equal to a gate-source voltage Vgs3 of the transistor M3, and the drain-source voltage Vds4 of the transistor M4 is equal to a gate-source voltage Vgs6 of the amplifier transistor M6. Therefore, the gate-source voltage Vgs3 of the transistor M3 should be equalized with the gate-source voltage Vgs6 of the amplifier transistor M6.

The drain-source voltage Vds4 of the transistor M4, which is also the gate-source voltage Vgs6 of the amplifier transistor M6, can be expressed as in the first formula $Vds4=Vgs6=-\sqrt{(2\times Id6/\beta 6)}+Vth6$, wherein β(beta)6 is a transconductance coefficient of the amplifier transistor M6, and Vth6 is a threshold voltage of the amplifier transistor M6.

The gate-source voltage Vgs3 of the transistor M3 can be expressed as in the second formula $Vds3=Vgs3=-\sqrt{(2\times Id3/\beta 3)}+Vth3$, wherein β3 is a transconductance coefficient of the transistor M3, and Vth3 is a threshold voltage of the transistor M3.

A condition under which a value of the first formula becomes equal to a value of the second formula can be expressed as in the third formula $\beta 6/\beta 3=Id6/Id3$.

Normally, a device size of each of the differential input transistors M1 and M2, the transistors M3 and M4, the current regulation transistor M5, and the amplifier transistor M6 is determined so as to satisfy the third formula.

For example, when a lithium ion battery is used as the power source P, a voltage VBAT of the lithium ion battery starts gradually decreasing from the initial voltage of about 4.3 V down to the final voltage of about 3.2 V. When the lithium ion battery is thus discharged, the output voltage from the amplifier circuit Vamp (i.e., the voltage at the point Va) also gradually decreases. This is because a value of a gate-source voltage Vgs8 of the output voltage control transistor M8 is kept constant when a value of a current IL flowing through the load Lo is constant, as observed from the fourth formula $Vgs8=-\sqrt{(2\times Id8/\beta 8)}+Vth8$, wherein β8 is a transconductance coefficient of the output voltage control transistor M8, and Vth8 is a threshold voltage of the output voltage control transistor M8.

That is, the output voltage from the amplifier circuit Vamp (i.e., the electric potential at the point Va), which is equal to Vgs8, changes by approximately a voltage of 1.1 V from the voltage of about 4.3 V to the voltage of about 3.2 V. Further, even when the voltage VBAT of the power source P is constant, if the current IL flowing through the load Lo changes, the gate-source voltage Vgs8 of the output voltage control transistor M8 changes. As a result, the output voltage from the amplifier circuit Vamp (i.e., the voltage at the point Va) changes. The output voltage from the amplifier circuit Vamp or the voltage at the point Va is also a drain-source voltage Vds7 of the current adjustment transistor M7. Even when a gate-source voltage Vgs7 of the current adjustment transistor M7 is constant, if the drain-source voltage Vds7 of the current adjustment transistor M7 changes, a drain current Id7 of the current adjustment transistor M7 changes due to a channel length modulation effect. The change of the drain current Id7 results in a change of a drain current Id6 of the amplifier transistor M6, since the drain current Id7 of the current adjustment transistor M7 is equal to the drain current Id6 of the amplifier transistor M6.

On the other hand, a drain-source voltage Vds5 of the current regulation transistor M5 can be expressed as in the fifth formula $Vds5=Vref-Vgs1=Vref-(\sqrt{(2\times Id1/\beta 1)}+Vth1)$ indicating a relationship between the reference voltage Vref and the gate-source voltage Vgs1 of the differential input transistor M1, wherein β1 is a transconductance coefficient of the differential input transistor M1, and Vth1 is a threshold voltage of the differential input transistor M1.

The gate-source voltage Vgs1 of the differential input transistor M1 takes an almost constant value. It is therefore determined from the fifth formula that the value of the drain-source voltage Vds5 of the current regulation transistor M5 is almost constant regardless of variation in the voltage VBAT of the power source P or variation in the current IL flowing through the load Lo. Accordingly, a drain current Id5 of the current regulation transistor M5 also takes an almost constant value.

As described above, the gate-source voltage Vgs6 of the amplifier transistor M6 is also the drain-source voltage Vds4 of the transistor M4. Therefore, when the gate-source voltage Vgs6 of the amplifier transistor M6 is changed, the drain-source voltage Vds4 of the transistor M4 is also changed. As a result, a drain current Id4 of the transistor M4 is changed due to the channel length modulation effect.

The drain current Id4 of the transistor M4 is equal to the drain current Id2 of the differential input transistor M2, and a sum of the drain current Id1 of the differential input transistor M1 and the drain current Id2 of the differential input transistor M2 is equal to the drain current Id5 of the current regulation transistor M5. Further, the value of the drain current Id5 of the current regulation transistor M5 is constant, as described above. Therefore, when the drain current Id2 of the differential input transistor M2 is changed, the drain current Id1 of the differential input transistor M1 is changed in an inverse direction to a direction in which the drain current Id2 is changed. As a result, a difference in voltage arises between the gate-source voltage Vgs1 of the differential input transistor M1 and the gate-source voltage Vgs2 of the differential input transistor M2. This difference in voltage results in the input offset voltage and causes a change in the output voltage Vout.

Usually, the output voltage Vout is added with a voltage value obtained by multiplying the value of the input offset voltage by (R1+R2)/R2, as an error margin.

SUMMARY

This patent specification describes a novel constant voltage outputting apparatus. In one example, a novel constant voltage outputting apparatus includes a differential amplifier circuit, an amplifier circuit, a current adjustment device and a stabilization circuit. The differential amplifier circuit is configured to perform a differential amplifying operation and output a differential amplified voltage. The amplifier circuit is configured to amplify the differential amplified voltage output from the differential amplifier circuit. The current adjustment device is configured to adjust a current characteristic of the amplifier circuit. The stabilization circuit is configured to stabilize a state of the current adjustment device.

This patent specification further describes another constant voltage outputting apparatus. In one example, this constant voltage outputting apparatus includes a reference voltage source, two output voltage detection resistors, a differential amplifier circuit, an amplifier circuit, a current adjustment device, a stabilization circuit and an output voltage control device. The reference voltage source is configured to output a reference voltage. The two output voltage detection resistors are configured to detect and divide an output voltage to generate a feedback voltage. The differential amplifier circuit is configured to receive an input voltage, the reference voltage and the feedback voltage, perform a differential amplifying operation, and output a differential amplified voltage. The amplifier circuit is configured to amplify the differential amplified voltage output from the differential amplifier circuit. The current adjustment device is configured to adjust a current characteristic of the amplifier circuit. The stabilization circuit is configured to stabilize a state of the current adjustment device. The output voltage control device is configured to receive the differential amplified voltage amplified by the amplifier circuit and control output of the output voltage to an external load based on the input voltage in accordance with the differential amplified voltage.

The differential amplifier circuit may include a current mirror circuit, two differential input transistors and a current regulation device. The current mirror circuit may be configured to generate mirror currents based on the input voltage. The two differential input transistors may be configured to be connected to the current mirror circuit and perform the differential amplifying operation based on the mirror currents, the reference voltage and the feedback voltage. The current regulation device may be configured to regulate a current characteristic of each of the two differential input transistors.

The stabilization circuit may include a stabilization transistor having a constant gate electric potential and being connected in series with the current adjustment device.

The stabilization circuit may include a bias voltage source configured to output a bias voltage, and a stabilization transistor configured to be placed between the amplifier circuit and the current adjustment device, and configured to have a gate connected to the bias voltage source and a source connected to a drain of the current adjustment device.

The stabilization circuit may include a depression-type stabilization transistor configured to be placed between the amplifier circuit and the current adjustment device, and configured to have a gate connected to a source of the current adjustment device and a source connected to a drain of the current adjustment device.

The stabilization circuit may include a constant current source, a first bias voltage generation device, a stabilization transistor and a second bias voltage generation device. The first bias voltage generation device may be configured to output, based on a current output from the constant current source, a first bias voltage to a gate of the current adjustment device and a gate of the current regulation device. The stabilization transistor may be configured to be placed between the amplifier circuit and the current adjustment device, and configured to have a source connected to a drain of the current adjustment device. The second bias voltage generation device may be configured to output, based on a current output from the constant current source, a second bias voltage to a gate of the stabilization transistor. A gate and a drain of the second bias voltage generation device may be connected to the constant current source, and a gate and a drain of the first bias voltage generation device may be connected to a source of the second bias voltage generation device.

The stabilization circuit may include a stabilization transistor configured to be placed between the amplifier circuit and the current adjustment device, and configured to have a gate connected to the reference voltage source and a source connected to a drain of the current adjustment device.

This patent specification further describes a novel constant voltage outputting method. In one example, a novel constant voltage outputting method includes providing a differential amplifier circuit configured to receive an input voltage a reference voltage, and a feedback voltage generated by dividing an output voltage, providing an amplifier circuit and a current adjustment device, inserting a stabilization circuit between the amplifier circuit and the current adjustment device, performing a differential amplifying operation with the differential amplifier circuit to output a differential amplified voltage, amplifying the differential amplified voltage with the amplifier circuit, adjusting a current characteristic of the amplifier circuit, stabilizing a state of the current adjustment device, and controlling output of the output voltage to an external load based on the input voltage in accordance with the differential amplified voltage amplified by the amplifier circuit.

The differential amplifier circuit may include a current mirror circuit, two differential input transistors and a current regulation device. The current mirror circuit may be configured to generate mirror currents based on the input voltage. The two differential input transistors may be configured to be connected to the current mirror circuit and perform the differential amplifying operation based on the mirror currents, the reference voltage and the feedback voltage. The current regulation device may be configured to regulate a current characteristic of each of the two differential input transistors.

The stabilization circuit may include a stabilization transistor having a constant gate electric potential and being connected in series with the current adjustment device.

The stabilization circuit may include a bias voltage source configured to output a bias voltage, and a stabilization transistor configured to have a gate connected to the bias voltage source and a source connected to a drain of the current adjustment device.

The stabilization circuit may include a depression-type stabilization transistor configured to have a gate connected to a source of the current adjustment device and a source connected to a drain of the current adjustment device.

The stabilization circuit may include a constant current source, a first bias voltage generation device, a stabilization transistor and a second bias voltage generation device. The first bias voltage generation device may be configured to output, based on a current output from the constant current source, a first bias voltage to a gate of the current adjustment device and a gate of the current regulation device. The stabilization transistor may be configured to have a source connected to a drain of the current adjustment device. The second bias voltage generation device may be configured to output, based on a current output from the constant current source, a second bias voltage to a gate of the stabilization transistor. A gate and a drain of the second bias voltage generation device may be connected to the constant current source, and a gate and a drain of the first bias voltage generation device may be connected to a source of the second bias voltage generation device.

The stabilization circuit may include a stabilization transistor configured to have a gate connected to a reference voltage source and a source connected to a drain of the current adjustment device.

BRIEF DESCRIPTION OF THE DRAWINGS

A more complete appreciation of the disclosure and many of the advantages thereof are readily obtained as the same becomes better understood by reference to the following detailed description when considered in connection with the accompanying drawings, wherein.

DETAILED DESCRIPTION OF PREFERRED EMBODIMENTS

Figure 1:
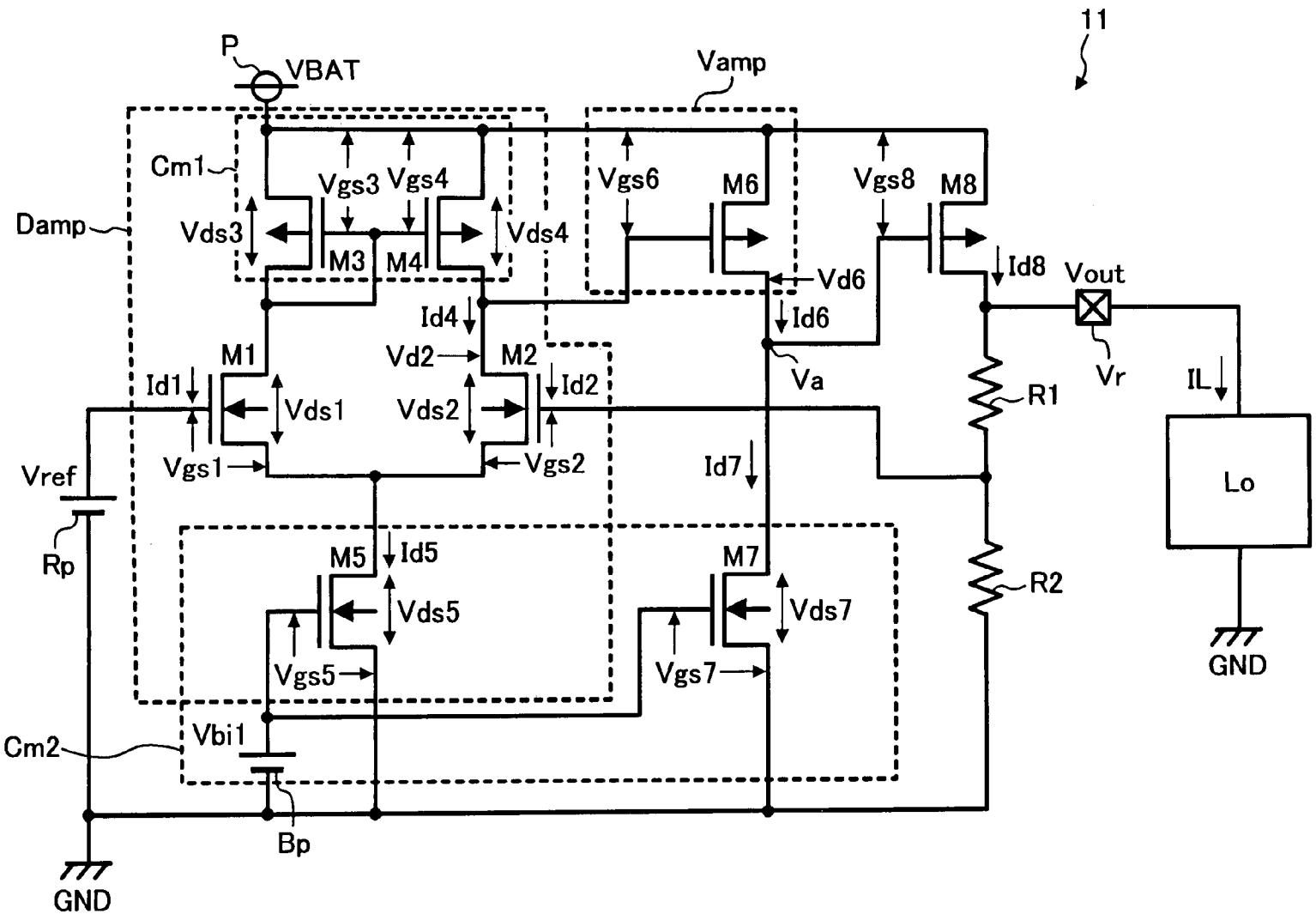
FIG. 1 PRIOR ART
FIG. 1 is a circuit diagram illustrating an exemplary configuration of a background constant voltage circuit.

In describing preferred embodiments illustrated in the drawings, specific terminology is employed for the purpose of clarity. However, the disclosure of this patent specification is not intended to be limited to the specific terminology so used and it is to be understood that substitutions for each specific element can include any technical equivalents that operate in a similar manner.

Figure 2:
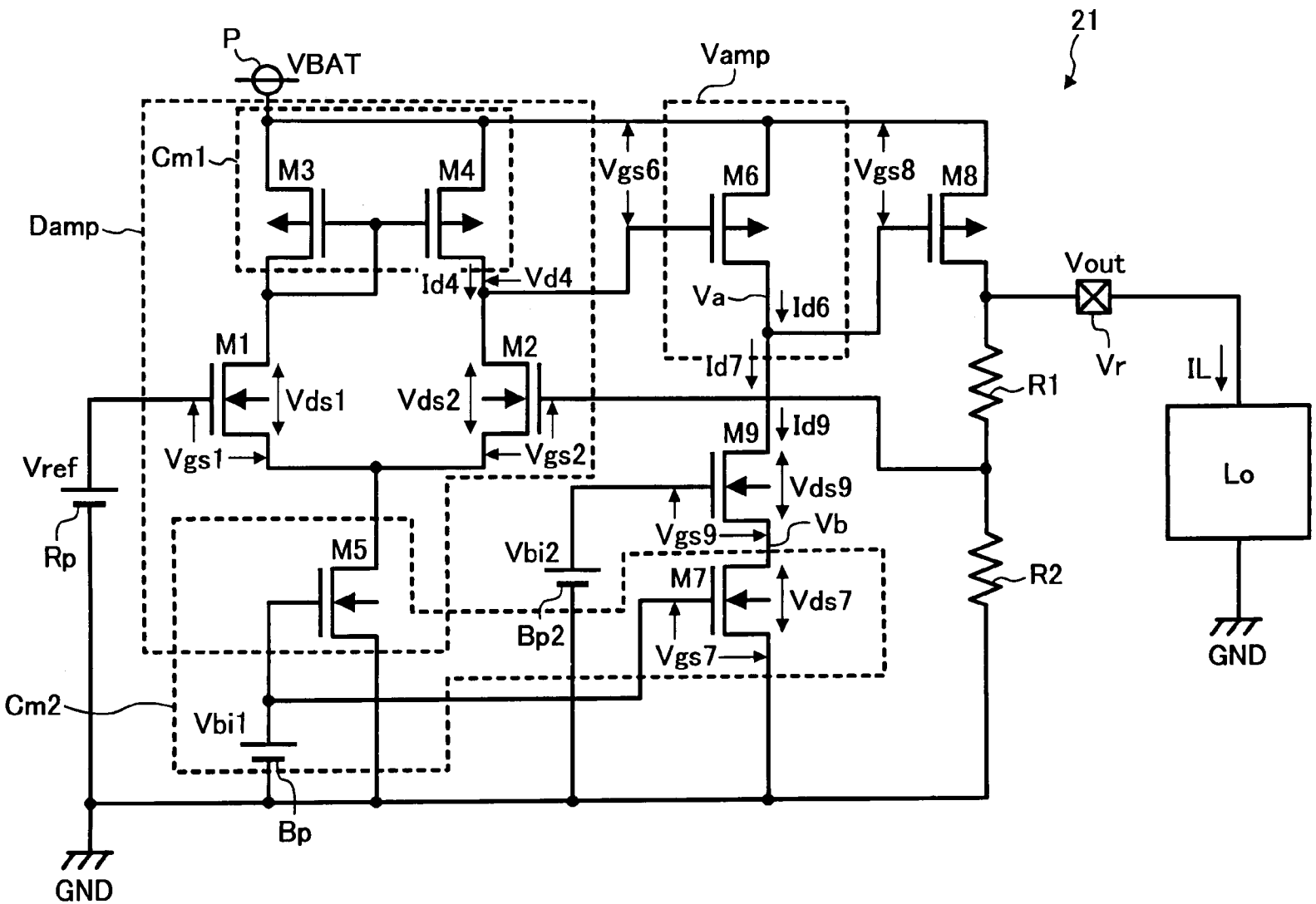
FIG. 2 is a circuit diagram illustrating an exemplary configuration of a constant voltage circuit according to an embodiment of this disclosure.

Referring now to the drawings, wherein like reference numerals designate identical or corresponding parts throughout the several views, FIG. 2 illustrates a configuration of a constant voltage circuit 21 according to an exemplary embodiment. Description is omitted for components of the constant voltage circuit 21 which are also components of the background constant voltage circuit shown in FIG. 1.

As illustrated in FIG. 2, the present constant voltage circuit 21 includes, as a stabilization circuit, a bias voltage source Bp2 and a stabilization transistor M9. The stabilization transistor M9, which may be a P-channel MOSFET, for example, stabilizes a state of the current adjustment transistor M7 such as the value of the drain current Id7.

The bias voltage source Bp2 has a negative voltage terminal connected to the ground voltage terminal GND, and a positive voltage terminal for outputting a bias voltage Vbi2.

The stabilization transistor M9 has a gate connected to the positive voltage terminal of the bias voltage source Bp2, a drain connected to the drain of the amplifier transistor M6 (i.e., the point Va), and a source connected to the drain of the current adjustment transistor M7.

In the constant voltage circuit 21 of FIG. 2, the drain-source voltage Vds7 of the current adjustment transistor M7 (i.e., a voltage at a point Vb) is stabilized as explained below. A value of a drain-source voltage Vds9 of the stabilization transistor M9 is obtained by subtracting a value of a gate-source voltage Vgs9 of the stabilization transistor M9 from a value of the bias voltage Vbi2. Namely, Vds9 can be expressed as Vds9=Vbi2−Vgs9. A value of the drain current Id9 of the stabilization transistor M9 is constant and equal to a value of the drain current Id7 of the current adjustment transistor M7. Since the value of the bias voltage Vbi2 applied to the gate of the stabilization transistor M9 is also kept constant, the gate-source voltage Vgs9 of the stabilization transistor M9 takes a constant value. This constant value of the gate-source voltage Vgs9 of the stabilization transistor M9 allows the drain-source voltage Vds7 of the current adjustment transistor M7 to take a constant value.

Accordingly, even when the voltage VBAT of the power source P or the current IL of the load Lo is changed and thus the output voltage from the amplifier transistor M6 (i.e., the voltage at the point Va) is changed, the drain-source voltage Vds7 of the current adjustment transistor M7 (i.e., the voltage at the point Vb) is stabilized. Therefore, the drain current Id7 of the current adjustment transistor M7 is unchanged and stabilized. As a result, the drain current Id6 of the amplifier transistor M6 is not changed, so that the value of the gate-source voltage Vgs6 of the amplifier transistor M6 is kept constant. Accordingly, the channel length modulation effect is reduced, and the drain current Id4 of the transistor M4 is stabilized. Further, the difference in voltage does not arise between the gate-source voltage Vgs1 of the differential input transistor M1 and the gate-source voltage Vgs2 of the differential input transistor M2, so that the input offset voltage is reduced without altering the balance between the current flowing through the differential input transistor M1 and the current flowing through the differential input transistor M2.

In the constant voltage circuit 21 of FIG. 2, the stabilization transistor M9 having a constant gate voltage stabilizes the drain current Id7 of the current adjustment transistor M7. As a result, the drain current Id6 of the amplifier transistor M6 is stabilized, so that the value of each of the drain voltage Vd4 and the drain current Id4 of the transistor M4 becomes constant and the input offset voltage is reduced. Accordingly, even if the voltage VBAT of the power source P or the current IL flowing through the load Lo is changed, accuracy in regulating the output voltage Vout is improved.

Figure 3:
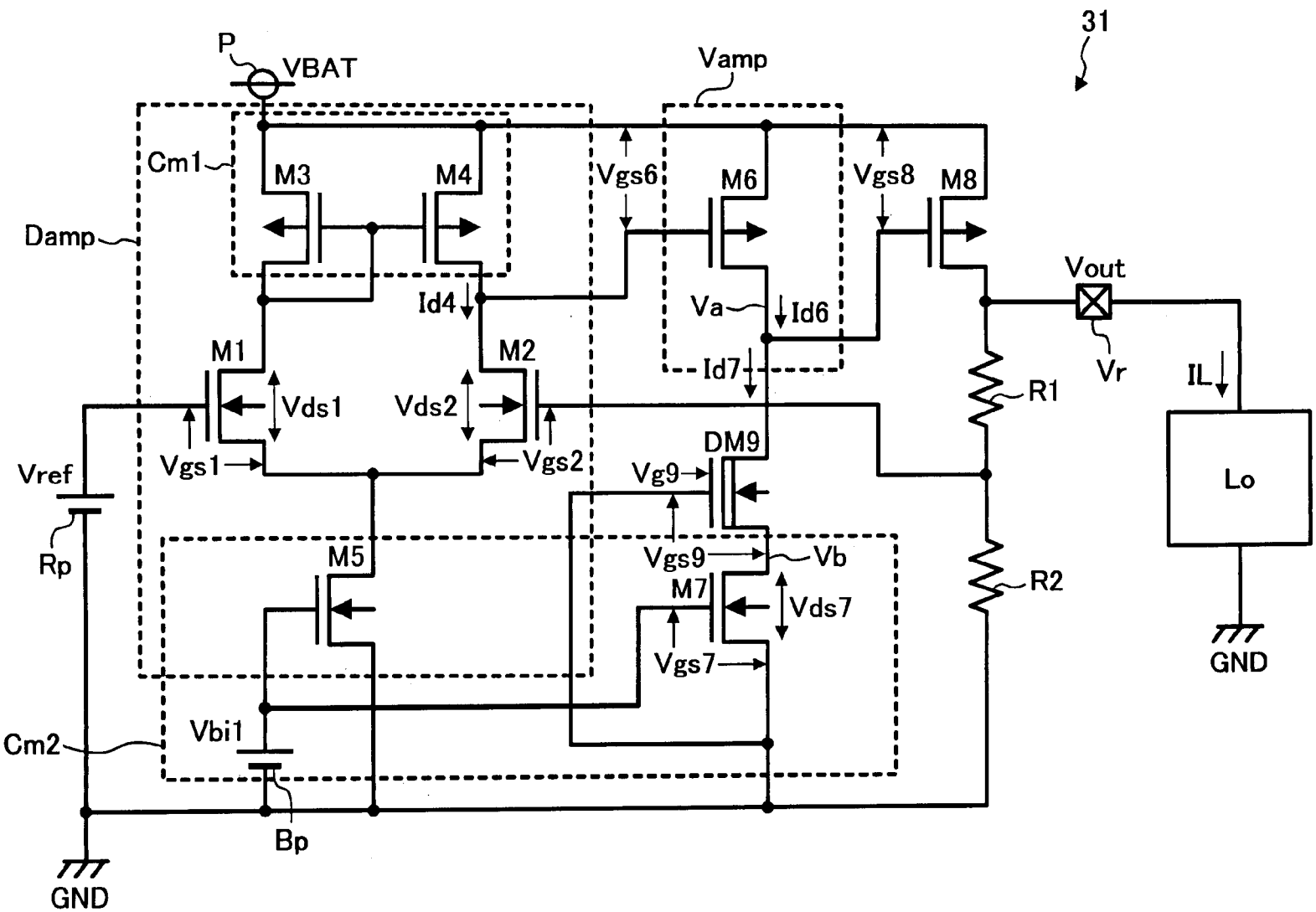
FIG. 3 is a circuit diagram illustrating an exemplary configuration of a constant voltage circuit according to another embodiment.

Referring to FIG. 3, a constant voltage circuit 31 according to another embodiment is described. Description is omitted for components of the constant voltage circuit 31 which are also components of the background constant voltage circuit 11 shown in FIG. 1.

As illustrated in FIG. 3, the constant voltage circuit 31 includes, as a stabilization circuit, a depression-type stabilization transistor DM9, which may be a D-N-channel MOSFET, for example.

The stabilization transistor DM9 has a gate connected to the source of the current adjustment transistor M7, which is at a side of the ground voltage terminal GND, a drain connected to the drain of the amplifier transistor M6, which is the point Va, and a source connected to the drain of the current adjustment transistor M7.

The value of the drain-source voltage Vds7 of the current adjustment transistor M7 is obtained by subtracting a value of a gate-source voltage Vgs9 of the stabilization transistor DM9 from a value of a gate voltage Vg9 of the stabilization transistor DM9. Namely, Vds7 can be expressed as Vds7=Vg9−Vgs9. The current adjustment transistor M7 operates in a saturation region, keeping the value of the drain-source voltage Vds7 constant. In other words, in accordance with the operation of the stabilization transistor DM9, the current adjustment transistor M7 operates in the saturation region to obtain a necessary drain-source voltage Vds7. As a result, the drain current Id7 of the current adjustment transistor M7 is unchanged and stabilized, so that the drain current Id6 of the amplifier transistor M6 is not changed, keeping the value of the gate-source voltage Vgs6 of the amplifier transistor M6 constant. Accordingly, the drain current Id4 of the transistor M4 is stabilized, and the difference in voltage does not arise between the gate-source voltage Vgs1 of the differential input transistor M1 and the gate-source voltage Vgs2 of the differential input transistor M2. As a result, the input offset voltage is reduced, without altering the balance between the current flowing through the differential input transistor M1 and the current flowing through the differential input transistor M2.

Similar to the case of the constant voltage circuit 21 of FIG. 2, in the constant voltage circuit 31 of FIG. 3, the state of the current adjustment transistor M7 is stabilized in the saturation region, and the drain current Id7 of the current adjustment transistor M7 is stabilized. As a result, the drain current Id6 of the amplifier transistor M6 is stabilized, so that the input offset voltage is reduced. Therefore, even if the voltage VBAT of the power source P or the current IL flowing through the load Lo is changed, the accuracy in regulating the output voltage Vout is improved. Further, since the constant voltage circuit 31 of FIG. 3 does not require a circuit element for generating the bias voltage Vbi2, the constant voltage circuit 31 consumes a smaller amount of current than the constant voltage circuit 21 of FIG. 2 does.

Figure 4:
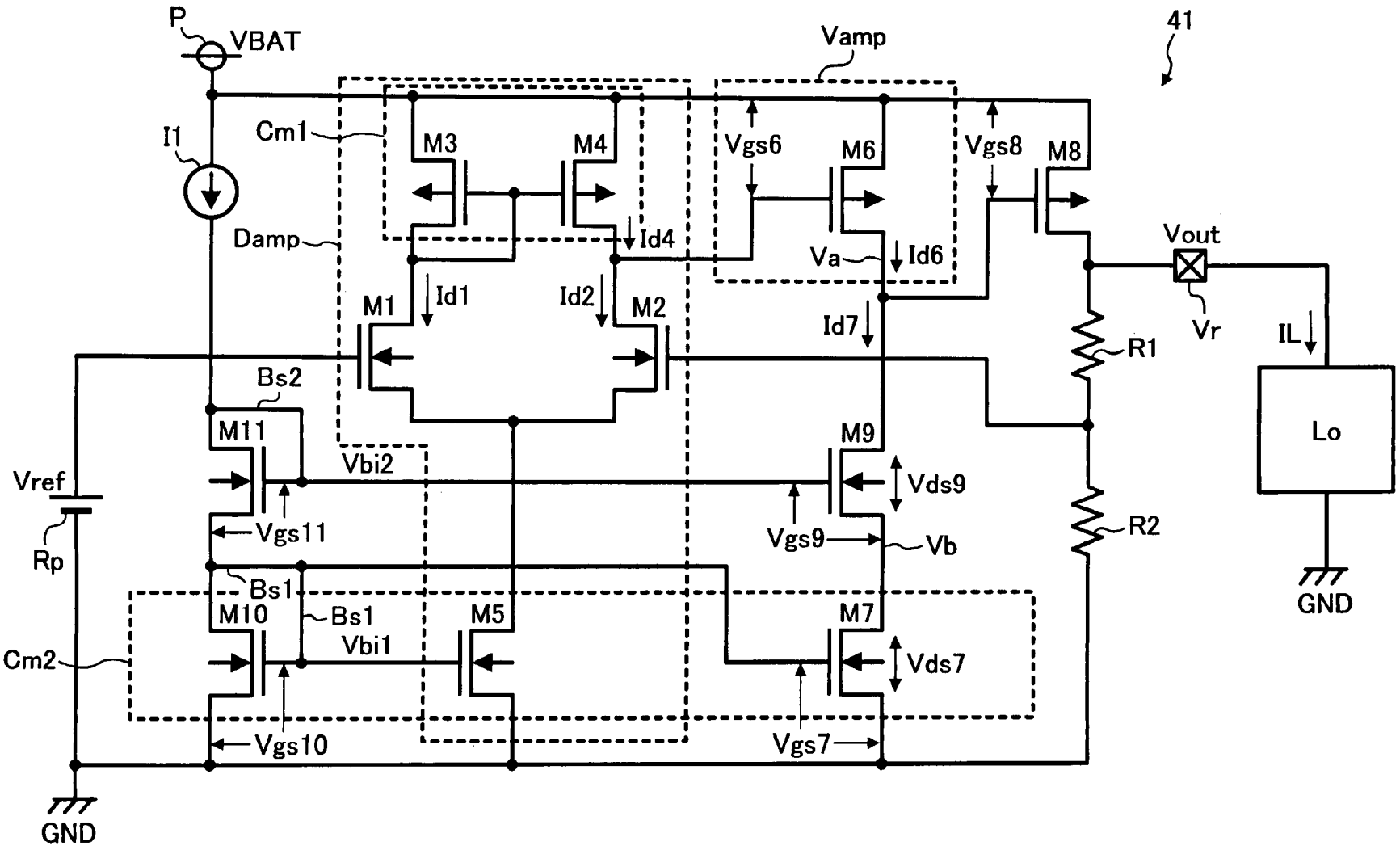
FIG. 4 is a circuit diagram illustrating an exemplary configuration of a constant voltage circuit according to still another embodiment.

Referring to FIG. 4, a constant voltage circuit 41 according to still another embodiment is described. Description is omitted for components of the constant voltage circuit 41 which are also components of the background constant voltage circuit 11 shown in FIG. 1.

As illustrated in FIG. 4, the constant voltage circuit 41 includes, as a stabilization circuit, a constant current source I1, a bias voltage generation transistor M10, a stabilization transistor M9 and a bias voltage generation transistor M11. Each of the bias voltage generation transistor M10 and the stabilization transistor M9 may be an N-channel MOSFET, for example, while the bias voltage generation transistor M11 may be a P-channel MOSFET, for example.

The constant current source I1 is connected to the power source P. The bias voltage generation transistor M10 has a gate connected to the gate of the current regulation transistor M5, a drain connected via the bias voltage generation transistor M11 to the constant current source I1, and a source connected to the ground voltage terminal GND. Further, a bias circuit Bs1 is provided to connect the drain of the bias voltage generation transistor M10 to the gate of the bias voltage generation transistor M10, and to connect the drain of the bias voltage generation transistor M10 to the gate of the current regulation transistor M5. The bias circuit Bs1 is further connected to the gate of the current adjustment transistor M7. The bias voltage generation transistor M10 outputs the bias voltage Vbi1 to the gate of the current regulation transistor M5 and to the gate of the current adjustment transistor M7.

The stabilization transistor M9 has a drain connected to the drain of the amplifier transistor M6 (i.e., the point Va), a source connected to the drain of the current adjustment transistor M7, and a gate connected to a gate of the bias voltage generation transistor M11.

The bias voltage generation transistor M11, the gate of which is connected to the gate of the stabilization transistor M9, has a drain connected to the constant current source I1 and a source connected to the drain of the bias voltage generation transistor M10. Further, a bias circuit Bs2 is provided to connect the drain of the bias voltage generation transistor M11 to the gate of the bias voltage generation transistor M11, and to connect the drain of the bias voltage generation transistor M11 to the gate of the stabilization transistor M9. The bias voltage generation transistor M11 outputs the bias voltage Vbi2 to the gate of the stabilization transistor M9.

The current regulation transistor M5 operates based on the bias voltage Vbi1 to keep a constant value of each of the drain current Id1 of the differential input transistor M1 and the drain current Id2 of the differential input transistor M2. On the other hand, the value of the drain-source voltage Vds7 of the current adjustment transistor M7 is obtained by subtracting the value of the gate-source voltage Vgs9 of the stabilization transistor M9 from a sum of a value of a gate-source voltage Vgs10 of the bias voltage generation transistor M10 and a value of a gate-source voltage Vgs11 of the bias voltage generation transistor M11. Namely, Vds7 can be expressed as Vds7=Vgs10+Vgs11−Vgs9. If the area size of each of the current adjustment transistor M7, the stabilization transistor M9, the bias voltage generation transistor M10 and the bias voltage generation transistor M11 is appropriately set, the drain-source voltage Vds9 of the stabilization transistor M9 is stabilized in accordance with the bias voltage Vbi2, and the current adjustment transistor M7 operates in the saturation region, so that the value of the drain-source voltage Vds7 of the current adjustment transistor M7 is kept constant. Accordingly, the drain current Id7 of the current adjustment transistor M7 is not changed, and thus the drain current Id6 of the amplifier transistor M6 is stabilized. As a result, the drain current Id4 of the transistor M4 is stabilized, so that the input offset voltage is reduced.

In the constant voltage circuit 41 of FIG. 4, in accordance with the bias voltage Vbi2, the stabilization transistor M9 causes the current adjustment transistor M7 to operate in the saturation region such that the value of the drain-source voltage Vds7 of the current adjustment transistor M7 is kept constant. Accordingly, the drain current Id6 flowing through the amplifier transistor M6 is stabilized, and the input offset voltage is reduced. As a result, even if the voltage VBAT of the power source P or the current IL flowing through the load Lo is changed, the accuracy in regulating the output voltage Vout can be improved.

Figure 5:
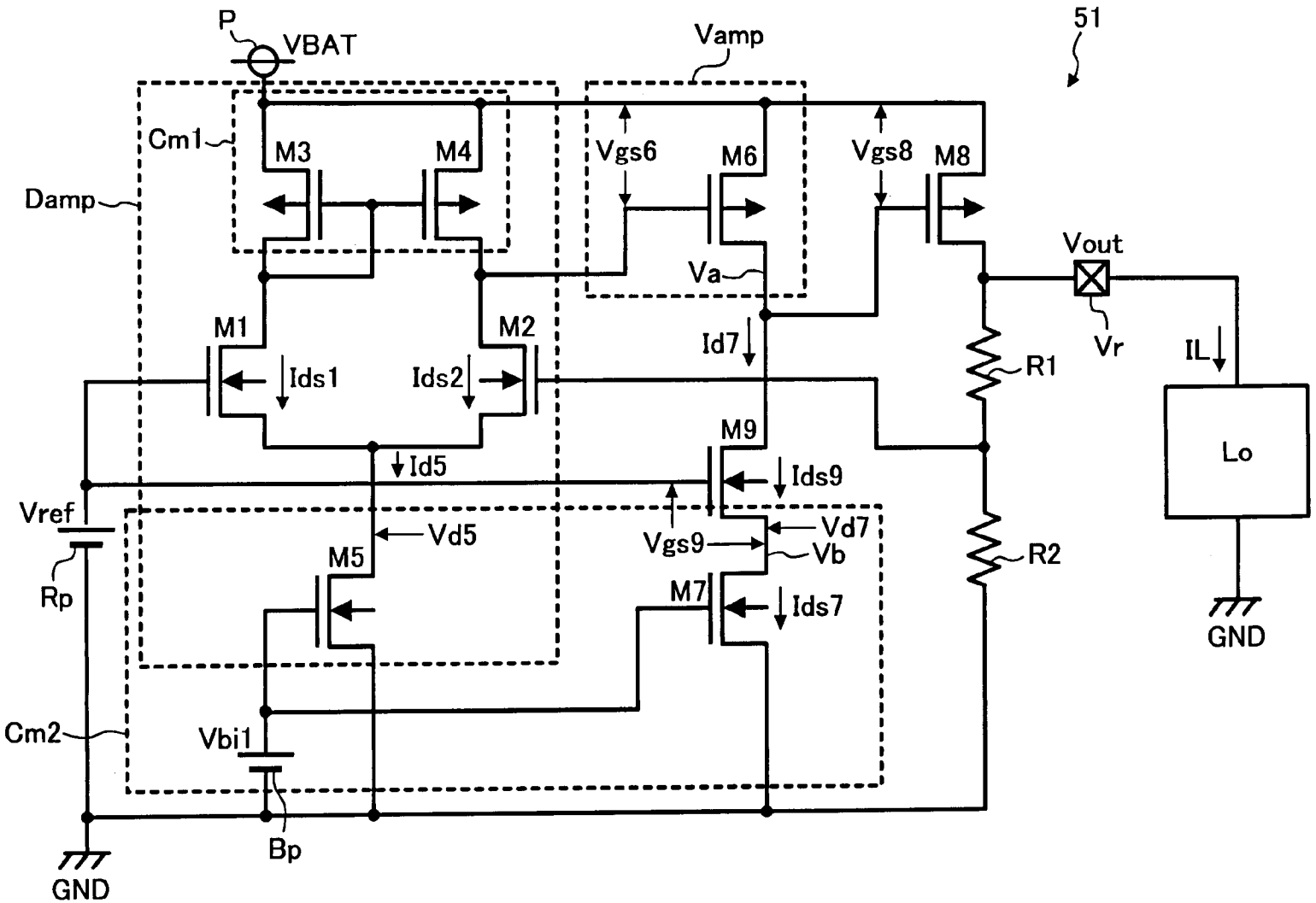
FIG. 5 is a circuit diagram illustrating an exemplary configuration of a constant voltage circuit according to still yet another embodiment.

Referring to FIG. 5, a constant voltage circuit 51 according to still yet another embodiment is described. Description is omitted for components of the constant voltage circuit 51 which are also components of the background constant voltage circuit 11 shown in FIG. 1.

The constant voltage circuit 51 of FIG. 5 is similar to the constant voltage circuit 21 of FIG. 2 in that the stabilization transistor M9 is provided as a stabilization circuit, but the constant voltage circuit 51 of FIG. 5 is different from the constant voltage circuit 21 of FIG. 2 in that the gate of the stabilization transistor M9 is connected to the reference voltage source Rp.

When the constant voltage circuit 51 of FIG. 5 is in a stable state, the drain current Id5 flowing through the current regulation transistor M5 that outputs currents to be supplied to the transistors M1 to M5, which serve as error amplifiers, is determined largely by the drain-source current Ids1 of the differential input transistor M1, the reference voltage Vref biased to the gate of the differential input transistor M1, and the threshold voltage and the transconductance coefficient of the differential input transistor M1. Therefore, if a ratio between the drain-source current Ids9 flowing through the stabilization transistor M9 and the drain-source current Ids1 flowing through the differential input transistor M1 is determined, it is possible to equalize an electric potential of the drain voltage Vd5 and an electric potential of the drain voltage Vd7, which are respective electric potentials of the current regulation transistor M5 and the current adjustment transistor M7 forming the current mirror circuit Cm2, by using the reference voltage Vref as a voltage to be biased to the gate of the stabilization transistor M9 and adjusting the type and area size of the stabilization transistor M9.

The source of the current regulation transistor M5 and the source of the current adjustment transistor M7 are connected to the ground voltage terminal GND. If the electric potential of the drain voltage Vd5 is equal to the electric potential of the drain voltage Vd7, the drain-source current Ids7 having a current value in proportion to an area size ratio between the current regulation transistor M5 and the current adjustment transistor M7 flows. Further, if the differential input transistor M1 and the stabilization transistor M9 are formed to have a similar area size and similar characteristics (e.g., both of the transistors M1 and M9 are N-channel MOSFETs), a change in the electric potential of the source caused by a change in a temperature characteristic, the reference voltage Vref, or the like, also becomes similar between the differential input transistor M1 and the stabilization transistor M9. As a result, consistency against an environmental variation between a constant current flowing through the current regulation transistor M5 and a constant current flowing through the current adjustment transistor M7 is improved. As a result, stability of the output voltage Vout output from the constant voltage circuit 51 is improved.

The constant voltage circuit 51 of FIG. 5 has an advantage of stabilizing the drain current Id6 of the amplifier transistor M6 and reducing the input offset voltage so that the accuracy in regulating the output voltage Vout is improved. In addition, since the constant voltage circuit 51 does not require the bias voltage source Bp2, the constant voltage circuit 51 has another advantage of reducing the number of circuit elements and the amount of current consumption so as to reduce man-hours and production costs required for producing the constant voltage circuit 51 and a running cost required for operating the constant voltage circuit 51, as in the case of the constant voltage circuit 31 of FIG. 3.

In each of the above embodiments, a transistor formed by an N-channel MOSFET may also be formed by a P-channel MOSFET, and a transistor formed by a P-channel MOSFET may also be formed by an N-channel MOSFET.

Furthermore, the use of the transistors M1 to M7 and M9, which are used for error amplification, is not limited within the constant voltage circuits 21, 31, 41 and 51, but the transistors are also applicable to a general operational amplifier circuit. If the transistors M1 to M7 and M9 are used in such a general operational amplifier circuit, occurrence of the offset voltage in input terminals can be suppressed, and gains of the operational amplifier circuit can be substantially improved. As a result, performance of the operational amplifier circuit can be substantially improved.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

This patent specification is based on Japanese patent application No. 2004-015724 filed on Jan. 23, 2004 in the Japan Patent Office, the entire contents of which are incorporated by reference herein.

What is claimed is:

1. A constant voltage outputting apparatus comprising:
- a differential amplifier circuit configured to perform a differential amplifying operation and output a differential amplified voltage;
- an amplifier circuit configured to amplify the differential amplified voltage output from the differential amplifier circuit;
- a current adjustment device configured to adjust a current characteristic of the amplifier circuit; and
- a stabilization circuit configured to stabilize a state of the current adjustment device.

2. The constant voltage outputting apparatus of claim 1, wherein the amplifier circuit amplifies the differential amplified voltage output from the differential amplifier circuit, and supplies an amplified voltage.

3. A constant voltage outputting apparatus comprising:
- a reference voltage source configured to output a reference voltage;
- two output voltage detection resistors configured to detect and divide an output voltage to generate a feedback voltage;
- a differential amplifier circuit configured to receive an input voltage, the reference voltage and the feedback voltage, perform a differential amplifying operation, and output a differential amplified voltage;
- an amplifier circuit configured to amplify the differential amplified voltage output from the differential amplifier circuit;
- a current adjustment device configured to adjust a current characteristic of the amplifier circuit;
- a stabilization circuit configured to stabilize a state of the current adjustment device; and an output voltage control device configured to receive the differential amplified voltage amplified by the amplifier circuit and control output of the output voltage to an external load based on the input voltage in accordance with the differential amplified voltage.

4. The constant voltage outputting apparatus as described in claim 3, wherein the differential amplifier circuit comprises:

a current mirror circuit configured to generate mirror currents based on the input voltage;

two differential input transistors configured to be connected to the current mirror circuit and perform the differential amplifying operation based on the mirror currents, the reference voltage and the feedback voltage; and a current regulation device configured to regulate a current characteristic of each of the two differential input transistors.

5. The constant voltage outputting apparatus as described in claim 3, wherein the stabilization circuit comprises a stabilization transistor having a constant gate electric potential and being connected in series with the current adjustment device.

6. The constant voltage outputting apparatus as described in claim 3, wherein the stabilization circuit comprises:

a bias voltage source configured to output a bias voltage; and a stabilization transistor configured to be placed between the amplifier circuit and current adjustment device, and configured to have a gate connected to the bias voltage source and a source connected to a drain of the current adjustment device.

7. The constant voltage outputting apparatus as described in claim 3, wherein the stabilization circuit comprises:

a depression-type stabilization transistor configured to be placed between the amplifier circuit and the current adjustment device, and configured to have a gate connected to a source of the current adjustment device and a source connected to a drain of the current adjustment device.

8. The constant voltage outputting apparatus as described in claim 3, wherein the stabilization circuit comprises:

a constant current source;

a first bias voltage generation device configured to output, based on a current output from the constant current source, a first bias voltage to a gate of the current adjustment device and a gate of the current regulation device;

a stabilization transistor configured to be placed between the amplifier circuit and the current adjustment device, and configured to have a source connected to a drain of the current adjustment device; and a second bias voltage generation device configured to output, based on a current output from the constant current source, a second bias voltage to a gate of the stabilization transistor.

9. The constant voltage outputting apparatus as described in claim 8, wherein a gate and a drain of the second bias voltage generation device are connected to the constant current source, and a gate and a drain of the first bias voltage generation device are connected to a source of the second bias voltage generation device.

10. The constant voltage outputting apparatus as described in claim 3, wherein the stabilization circuit comprises:

a stabilization transistor configured to be placed between the amplifier circuit and the current adjustment device, and configured to have a gate connected to the reference voltage source and a source connected to a drain of the current adjustment device.

11. A constant voltage outputting apparatus comprising:

differential amplifying means for performing a differential amplifying operation and outputting a differential amplified voltage;

amplifying means for amplifying the differential amplified voltage output from the differential amplifying means;

current adjusting means for adjusting a current characteristic of the amplifying means; and stabilizing means for stabilizing a state of the current adjusting means.

12. A constant voltage outputting apparatus comprising:

reference voltage supplying means for outputting a reference voltage;

feedback voltage generating means for generating a feedback voltage;

differential amplifying means for receiving an input voltage, the reference voltage and the feedback voltage, performing a differential amplifying operation, and outputting a differential amplified voltage;

amplifying means for amplifying the differential amplified voltage output from the differential amplifying means;

current adjusting means for adjusting a current characteristic of the amplifying means;

stabilizing means for stabilizing a sate of the current adjusting means; and output voltage control means for controlling output of the output voltage to an external load based on the input voltage in accordance with the differential amplified voltage amplified by the amplifying means.

13. The constant voltage outputting apparatus as described in claim 12, wherein the differential amplifying means comprises:

minor current generating means for generating mirror currents based on the input voltage;

differential input means for performing the differential amplifying operation based op the mirror currents, the reference voltage and the feedback voltage, said differential input means being connected to the minor current generating means; and current regulating means for regulating a current characteristic of the differential input means.

14. The constant voltage outputting apparatus as described in claim 12, wherein the stabilizing means comprises a stabilization transistor having a constant gate electric potential and being connected in series with the current adjusting means.

15. The constant voltage outputting apparatus as described in claim 12, wherein the stabilizing means comprises:

bias voltage supplying means for outputting a bias voltage; and a stabilization transistor configured to be placed between the amplifying means and the current adjusting means, and configured to have a gate connected to the bias voltage supplying means and a source connected to a drain of the current adjusting means.

16. The constant voltage outputting apparatus as described in claim 12, wherein the stabilizing means comprises:

a depression-type stabilization transistor configured to be placed between the amplifying means and the current adjusting means, and configured to have a gate connected to a source of the current adjusting means and a source connected to a drain of the current adjusting means.

17. The constant voltage outputting apparatus as described in claim 12, wherein the stabilizing means comprises:

constant current supplying means;

first bias voltage generating means for outputting, based on a current output from the constant current supplying means, a first bias voltage to a gate of the current adjusting means and a gate of the current regulating means;

a stabilization transistor configured to be placed between the amplifying means and the current adjusting means, and configured to have a source connected to a drain of the current adjusting means; and second bias voltage generating means for outputting, based on a current output from the constant current supplying means, a second bias voltage to a gate of the stabilization transistor.

18. The constant voltage outputting apparatus as described in claim 17, wherein a gate and a drain of the second bias voltage generating means are connected to the constant current supplying means, and a gate and a drain of the first bias voltage generating means are connected to a source of the second bias voltage generating means.

19. The constant voltage outputting apparatus as described in claim 12, wherein the stabilizing means comprises:

a stabilization transistor configured to be placed between the amplifying means and the current adjusting means, and configured to have a gate connected to the reference voltage supplying means and a source connected to a drain of the current adjusting means.

20. A constant voltage outputting method comprising:

providing a differential amplifier circuit configured to receive an input voltage, a reference voltage and a feedback voltage generated by dividing an output voltage;

providing an amplifier circuit and a current adjustment device;

inserting a stabilization circuit between the amplifier circuit and the current adjustment device;

performing a differential amplifying operation through the differential amplifier circuit to output a differential amplified voltage;

amplifying the differential amplified voltage through the amplifier circuit;

adjusting a current characteristic of the amplifier circuit;

stabilizing a state of the current adjustment device; and controlling output of the output voltage to an external load based on the input voltage in accordance with the differential amplified voltage amplified by the amplifier circuit.

21. The constant voltage outputting method as described in claim 20, wherein the differential amplifier circuit comprises:

a current mirror circuit configured to generate mirror currents based on the input voltage;

two differential input transistors configured to be connected to the current mirror circuit and perform the differential amplifying operation based on the mirror currents, the reference voltage and the feedback voltage; and a current regulation device configured to regulate a current characteristic of each of the two differential input transistors.

22. The constant voltage outputting method as described in claim 20, wherein the stabilization circuit comprises a stabilization transistor having a constant gate electric potential and being connected in series with the current adjustment device.

23. The constant voltage outputting method its described in claim 20, wherein the stabilization circuit comprises:

a bias voltage source configured to output a bias voltage; and a stabilization transistor configured to have a gate connected to the bias voltage source and a source connected to a drain of the current adjustment device.

24. The constant voltage outputting method as described in claim 20, wherein the stabilization circuit comprises:

a depression-type stabilization transistor configured to have a gate connected to a source of the current adjustment device and a source connected to a drain of the current adjustment device.

25. The constant voltage outputting method as described in claim 20, wherein the stabilization circuit comprises:

a constant current source;

a first bias voltage generation device configured to output, based on a current output from the constant current source, a first bias voltage to a gate of the current adjustment device and a gate of the current regulation device;

a stabilization transistor configured to have a source connected to a drain of the current adjustment device; and a second bias voltage generation device configured to output, based on a current output from the constant current source, a second bias voltage to a gate of the stabilization transistor.

26. The constant voltage outputting method as described in claim 25, wherein a gate and a drain of the second bias voltage generation device are connected to the constant current source, and a gate and a drain of the first bias voltage generation device are connected to a source of the second bias voltage generation device.

27. The constant voltage outputting method as described in claim 20, wherein the stabilization circuit comprises:

a stabilization transistor configured to have a gate connected to a reference voltage source and a source connected to a drain of the current adjustment device.

* * * * *